US008381771B2

(12) United States Patent
Goeggelmann et al.

(10) Patent No.: US 8,381,771 B2
(45) Date of Patent: Feb. 26, 2013

(54) MATERIAL FEED CONTAINER FOR A THICK-MATTER PUMP

(75) Inventors: Gernot Goeggelmann, Deizisau (DE); Helmut Hurr, Reutlingen (DE); Markus Fritz, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 117 days.

(21) Appl. No.: 12/931,090

(22) Filed: Jan. 24, 2011

(65) Prior Publication Data

US 2011/0168706 A1 Jul. 14, 2011

Related U.S. Application Data

(62) Division of application No. 10/593,858, filed as application No. PCT/EP2004/014412 on Dec. 17, 2004, now Pat. No. 7,900,651.

(30) Foreign Application Priority Data

Mar. 25, 2004 (DE) ..... 10 2004 015 181

(51) Int. Cl.
*F04B 39/12* (2006.01)

(52) U.S. Cl. ..... 137/874; 417/900

(58) Field of Classification Search ..... 137/874; 222/626; 417/900

See application file for complete search history.

(56) References Cited

U.S. PATENT DOCUMENTS

| | | | | |
|---|---|---|---|---|
| 3,232,368 | A | 2/1966 | Sullivan | |
| 3,298,322 | A | 1/1967 | Sherrod | |
| 3,995,734 | A | 12/1976 | Berg, Jr. et al. | |
| 4,036,564 | A | 7/1977 | Richards | |
| 4,178,142 | A | 12/1979 | Schwing | |
| 4,382,752 | A | 5/1983 | Schlecht | |
| 4,458,879 | A | 7/1984 | Jandrasi | |
| 4,893,992 | A * | 1/1990 | Schlecht | 417/238 |
| 5,193,636 | A | 3/1993 | Holm | |
| 5,302,094 | A | 4/1994 | Schlecht et al. | |
| 5,460,301 | A * | 10/1995 | Ebinger et al. | 222/626 |
| 6,382,922 | B1 * | 5/2002 | Lewis et al. | 417/38 |
| 6,488,477 | B1 | 12/2002 | Hurr | |

(Continued)

FOREIGN PATENT DOCUMENTS

| | | |
|---|---|---|
| DE | 1 530 907 | 7/1969 |
| DE | 42 08 831 | 9/1993 |

(Continued)

OTHER PUBLICATIONS

International Search Report of PCT/EP04/14412.

(Continued)

*Primary Examiner* — John Fox
(74) *Attorney, Agent, or Firm* — Collard & Roe, P.C.

(57) ABSTRACT

The invention relates to a material feed receptacle for a thick matter pump comprising a receptacle lower part and a receptacle top that is detachably connected to the receptacle lower part, a two-part front wall, a rear wall, two two-part lateral walls, an upwardly pointing material feed opening delimited by a peripheral edge, and a pipe junction, which is situated inside the receptacle, can, on the entry side, swivel in an alternating manner in front of the delivery cylinder openings and which, on the output side, leads to a pressure pipe. The invention provides that the receptacle top has an upper lateral wall part and upper lateral wall parts, which have free ends and which extend away from the front wall part. The invention also provides that the peripheral edge has a first edge part, which forms an upper edge of the receptacle top, and ha a second edge part on the receptacle lower part, which is situated on the rear wall and is joined to the first edge part.

10 Claims, 8 Drawing Sheets

U.S. PATENT DOCUMENTS

| | | | |
|---|---|---|---|
| 6,857,861 | B2 | 2/2005 | Condon et al. |
| 7,048,006 | B2 | 5/2006 | Hurr |
| 7,131,820 | B2 | 11/2006 | Benckert |
| 2003/0170127 | A1 | 9/2003 | Muenzenmaier et al. |

FOREIGN PATENT DOCUMENTS

| | | |
|---|---|---|
| EP | 0 468 322 | 1/1992 |
| EP | 1 076 596 | 2/2001 |
| WO | WO 92/18794 | 10/1992 |
| WO | WO 03/019007 | 3/2003 |
| WO | WO 03/042535 | 5/2003 |

OTHER PUBLICATIONS

International Preliminary Report on Patentability of PCT/EP04/14412.

* cited by examiner

MATERIAL FEED CONTAINER FOR A THICK-MATTER PUMP

CROSS REFERENCE TO RELATED APPLICATIONS

This application is a divisional of and Applicants claim priority under 35 U.S.C. §§120 and 121 on U.S. application Ser. No. 10/593,858 filed on Sep. 22, 2006, now U.S. Pat. No. 7,900,651, which application is a national stage application under 35 U.S.C. §371 of PCT Application No. PCT/EP04/14412 filed Dec. 17, 2004, which claims priority under 35 U.S.C. §119 from German Patent Application No. 10 2004 015 181.4 filed Mar. 25, 2004, the disclosures of each of which are hereby incorporated by reference.

BACKGROUND OF THE INVENTION

1. Field of the Invention

The invention relates to a material feed container for a thick-matter pump.

2. The Prior Art

A material feed container for thick-matter pumps is known from EP 1 076 596 B1, which has a lower container part that is open towards the top, and a container top releasably connected with the former by way of a flange connection. The circumferential upper edge of the container top delimits the material feed opening. A stirrer mechanism is mounted in the lower container part; its mountings are situated in a recess of the lower container part open at the edge, so that the stirrer mechanism can be easily interchanged after the container top has been removed. The container top forms a filling funnel for thick matter, such as concrete. Filling-in of the concrete generally takes place in that a mixer truck drives up to the material feed container and fills the concrete into the material feed container by way of a chute. In order to avoid damage to the container top due to a collision with the mixer truck that drives up, the container top must consist of stable sheet metal. This requires a great weight, so that the container top cannot simply be removed by hand.

Material feed containers according to EP 1 076 596 B1 have intermediate rings as wear parts in the feed cylinder openings, which rings protect the inner surface of the feed cylinder opening, which is part of the container face wall, against wear due to concrete flowing through. Because of wear, these intermediate rings must be replaced regularly. Since the intermediate rings are inserted into the feed cylinder opening from the feed cylinder side, the feed cylinder must first be removed from the container face wall, for assembly and disassembly. This is complicated.

SUMMARY OF THE INVENTION

It is the task of the invention to further develop a material feed container of the type stated initially, in such a manner that it is easier to maintain and that wear parts can be replaced more simply.

This task is accomplished by means of a material feed container in accordance with the invention. Advantageous embodiments of the invention are discussed below.

In one aspect, the invention is based on the idea of making the interior of the material feed container more easily accessible to maintenance personnel, in that it has a container top that can easily be detached and removed, on the face wall side. However, the container top does not extend to the rear wall, which faces the mixer truck that drives up. Thus, the circumferential edge that delimits the material feed opening has an edge part that belongs to the lower container part, on the rear wall side. The container top is thereby protected against damage caused by the mixer truck. It therefore does not have to be structured to be as stable as the lower container part, and can have a relatively low weight.

It is advantageous if the first edge part situated on the container top aligns with the second edge part that belongs to the lower container part. The material feed opening can then be covered, in simple manner, by means of a hinged lid that is articulated onto the container top, at the upper face wall part. The hinged lid is preferably made of plastic, so that concrete residue adheres less well to it than to a metal lid. The hinged lid is therefore easier to clean.

It is practical if the lower container part has a rear wall, a floor, a lower face wall part, and lower side wall parts that drop towards the lower face wall part. It is advantageous if the upper face wall part and the upper side wall parts of the container top bear a first flange on their lower edge, which flange is releasably connected with a complementary second flange on the lower face wall part and on the lower side wall parts of the lower container part. It is practical if a sealing means is disposed between the first flange and the second flange. This results in a good sealing effect at the parting line between lower container part and container top.

It is practical if the lower face wall part, the rear wall, the lower side wall parts of the lower container part and/or the floor consist of sheet metal, preferably of stable steel sheet. An advantageous alternative consists in having the lower face wall part, the rear wall, the lower side wall parts and/or the floor consist at least partially of a light construction material. The light construction material can have a carbon-fiber-reinforced plastic and/or a fiberglass-reinforced plastic. It is also possible that the light construction material is silicon carbide or a metal foam, preferably with titanium components. It is practical if the light construction material carries a friction-wear-resistant and/or hard coating, particularly from the material group of chrome, silicon carbide, or ceramic. The feed cylinder openings are preferably disposed in the lower face wall part. Furthermore, a support device for the tube switch is preferably mounted in the lower container part. Furthermore, it is practical if the lower container part has pivot bearings for a stirrer mechanism. In this way, the forces transferred by the feed cylinders, the tube switch, and the stirrer mechanism during pump operation, which can be considerable, are absorbed by the lower container part. The container top, which merely has to absorb the forces that result from filling-in of the thick matter, can therefore be configured to be significantly less stable and therefore lighter.

The upper face wall part and the upper side wall parts of the container top can also consist of sheet metal, preferably of steel sheet. In this connection, lower wall thickness values are possible than in the case of the sheet metal of the lower container part. However, it is preferred that the upper face wall part and the upper side wall parts consist of plastic. It is advantageous if the container top is produced in one piece, as an injection-molded part. It is practical if a contact bead for a lattice grid is molded onto this injection-molded part, facing the container interior. Likewise, reinforcement strips can be molded onto the upper face wall part and/or the upper side wall parts, which strips impart greater stability to the container top.

Alternatively or supplementally, the container top, in this connection particularly the face wall part and/or the upper side wall parts, can consist at least partially of a light construction material. In practical manner, the light construction material used for this purpose can have a carbon-fiber-reinforced plastic and/or a fiberglass-reinforced plastic. It is also possible that the light construction material is silicon carbide or a metal foam, which preferably has titanium components. It is practical if the light construction material bears a friction-wear-resistant and/or hard coating, particularly from the material group of chrome, silicon carbide, or ceramic.

Alternatively or additionally to the contact bead on the container top, the lower container part can have contact elements for a lattice grid that project beyond the lower face wall part. This is particularly advantageous if the lattice grid is very heavy and its weight cannot be borne by the container top. It is practical if the second, rear wall side edge part of the material feed opening is formed by a rubber apron affixed to the lower container part. The latter follows the rear wall and segments of the side walls that proceed from the rear wall.

It is preferred that the lower container part and the container top are connected with one another by means of screws. This results in a simple, stable, and nevertheless easily releasable connection.

The solution according to the invention according to another aspect is based on the idea that a hinged lid, which covers the material feed opening, is articulated onto a container wall, and is made of plastic or a light construction material, is easier to clean than a conventional hinged lid made of sheet metal. Thick matter, particularly concrete, adheres to plastic significantly more poorly than to sheet metal. It is practical if the hinged lid is configured as a hollow plastic body having a first plastic shell that faces the material feed opening, and a second plastic shell, preferably connected in one piece with the former, forming an upper lid part. A hollow plastic body is relatively stable, while having low weight. This is particularly advantageous if the hinged lid is articulated onto the container top and must be removed together with the container top for maintenance work in the container interior.

In order to facilitate cleaning, the first plastic shell can have a smooth surface that faces the material feed opening. In contrast, it is preferred that the second plastic shell has reinforcement beads. This imparts increased stability to the hinged lid. It is advantageous if the hinged lid is produced in one piece, using a rotation casting method.

If the hinged lid consists at least partially of a light construction material, it is practical if the lid has a carbon-fiber-reinforced plastic and/or a fiberglass-reinforced plastic. The light construction material can also be silicon carbide, or a metal foam that preferably has titanium components. It is practical if the light construction material bears a friction-wear-resistant and/or hard coating, particularly from the material group of chrome, silicon carbide, or ceramic.

It is practical if the hinged lid has handles, which are preferably molded on in one piece. Furthermore, it is practical if it has hooks into which closure elements attached to a container wall can be hooked. Also, it is preferable if the hooks are molded onto the hinged lid in one piece. The hinged lid is preferably connected with the container face wall by means of at least one hinge and at least one gas spring. The gas spring facilitates opening of the lid. Close to its side connected with the container face wall, it is practical if the hinged lid has attachment means for a rubber apron on the first plastic shell. This apron hangs down from the hinged lid into the material feed opening and prevents thick matter from flowing into the gap between the hinged lid and the container face wall.

The solution according to the invention according to another aspect is based on the idea that it requires less effort to mount and detach the intermediate rings by way of the container interior than by way of the container exterior. In this way, it is avoided that the feed cylinders have to be uncoupled from the material feed container in the case of replacement of the intermediate rings. An intermediate ring is inserted into the feed cylinder opening by way of the container interior, in that the toe is pushed into the bayonet opening on its outer mantle surface, and the intermediate ring is subsequently rotated about its longitudinal axis, so that the toe is introduced into the inner groove. Mounting of an intermediate ring by way of the container interior is particularly advantageous if the material feed container is configured in two parts, as described above. The container interior is easily accessible by removing the relatively light container top.

The inner groove can be configured to be circumferential in the feed cylinder opening. Preferably, the intermediate ring has at least two, preferably three toes, disposed at an equal angle distance from one another, on its outer mantle surface. The feed cylinder opening then has a number of bayonet openings that corresponds to the number of toes, which are also disposed at the same angle distance from one another. Since the intermediate ring is fixed in place, in the axial direction, by means of the engagement of the toes in the inner groove, this fixation is all the more stable, the more toes are disposed on the outer mantle surface.

It is practical if a connector plate for connecting feed cylinders is affixed to the container outside on the container face wall, through which plate the feed cylinder openings extend. Furthermore, it is practical if a spectacle plate having two spectacle plate openings is attached to the inner surface of the container face wall. The spectacle plate openings communicate with the feed cylinder openings, and their delimitation surfaces align with the delimitation surfaces of the flow-through-channels in the intermediate rings. The spectacle plate therefore covers part of the feed cylinder openings and additionally fixes the intermediate rings in place in the direction towards the container interior. The spectacle plate is removed for replacement of the intermediate rings.

It is practical if the intermediate ring and/or the spectacle plate consist at least partially of a friction-wear-resistant light construction material. The light construction material can have a carbon-fiber-reinforced plastic and/or a fiberglass-reinforced plastic. It is also possible that the light construction material is silicon carbide or a metal foam, whereby the latter preferably has titanium components.

It is practical if the delimitation surfaces of the flow-through-channels and/or the spectacle plate openings are coated with a friction-wear-resistant layer. The latter preferably consists of a hard metal or of a material from the material group of chrome, silicon carbide, or ceramic. The spectacle plate and the intermediate rings, which are wear parts, in each instance, are protected against friction wear by the friction-wear-resistant layer, and therefore need to be replaced less frequently.

It can be provided that the diameter of the flow-through-channel narrows towards the container interior or towards the feed cylinder. In this way, feed cylinders having different inside diameters can be connected with the material feed container, in that different intermediate rings are inserted into the feed cylinder openings. It is practical if the flow-through-channels are dimensioned in such a manner that their delimitation surfaces align with the inner surfaces of the feed cylinders.

It is advantageous if the intermediate ring has at least one circumferential groove, offset axially relative to the toes, in its mantle surface, with a sealing ring for contact against the container face wall and/or the connector plate. Preferably, it has two circumferential grooves, one of which accommodates a sealing ring that lies against the container face wall, the other of which accommodates a sealing ring that lies against the connector plate. The intermediate ring can have another circumferential groove on a face facing the spectacle plate, having a sealing ring that lies against the spectacle plate. By means of these measures, one achieves a good seal of the material feed container in the region of the feed cylinder openings.

To facilitate assembly and disassembly, the intermediate ring can have recesses for the insertion of holder mandrels on a face that faces the spectacle plate. Furthermore, a circumferential cavity can be disposed between the intermediate ring and the container face wall, which cavity can be filled with lubricant by way of a feed opening, and increases in size when the intermediate ring is pulled out of the feed cylinder opening. To remove the intermediate ring, an assembly ring with holder mandrels that engage into the recesses of the intermediate ring is then used. With the help of the assembly ring, the intermediate ring is turned to release the bayonet closure. Subsequently, a lubricant, such as grease, is pressed into the cavity, so that the intermediate ring is pressed out of the feed cylinder opening, whereby the toes are moved through the bayonet openings.

BRIEF DESCRIPTION OF THE DRAWINGS

In the following, the invention will be explained in greater detail using exemplary embodiments shown schematically in the drawing. This shows FIG. 1 a side view of a movable concrete pump having a rear material feed container.

DETAILED DESCRIPTION OF PREFERRED EMBODIMENTS

Figure 1:
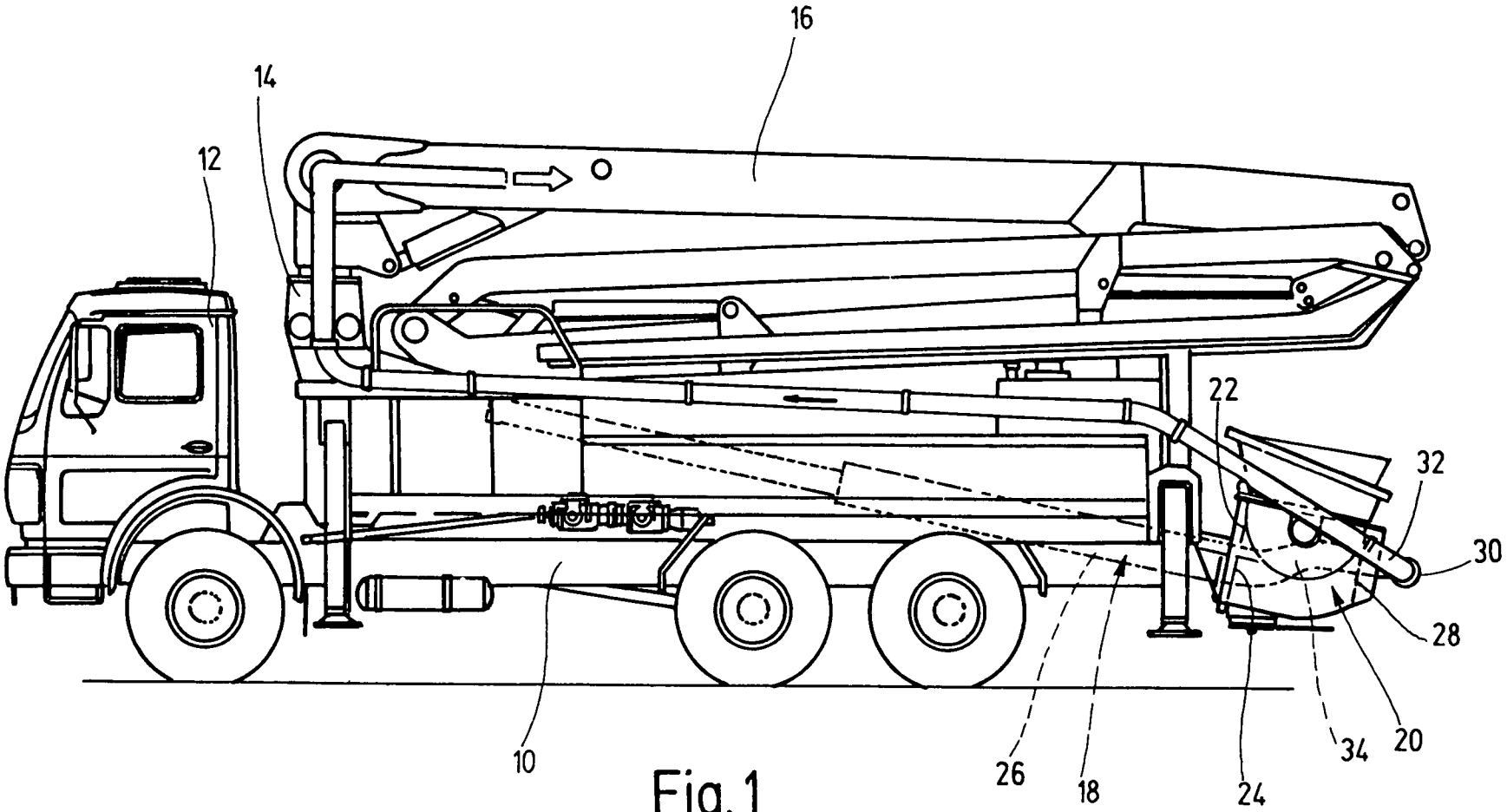

The automotive concrete pump shown in FIG. 1 in the driven state has a chassis 10, a front side driver's cabin 12, a concrete distributor mast 16 mounted on a rotary bearing block 14 of the chassis 10, and a two cylinder thick-matter pump 18 disposed on the chassis 10. The material feed container 20 disposed in the rear part of the chassis 10 has feed cylinder openings 24 in its face wall 22, by way of which openings the two feed cylinders 26 of the thick-matter pump 18 are connected. On the rear wall 28 of the material feed container 20, lying opposite the face wall 22, there is a pressure joint 30, to which a feed line 32 is connected. In the container interior, there is a tube switch 34 configured here as an S-pipe, which is connected with the pressure joint 30 with its one end and the other end of which can be pivoted alternately about the axis of a pivot shaft, not shown here, in front of the two feed cylinder openings 24, using hydraulic means.

The material feed container 20 (FIG. 2) is divided into a lower container part 38 and a container top 40. The face wall 22 as well as the side walls 42 that connect the face wall 22 with the rear wall 28 are divided in two, into an upper and a lower part, in each instance. In this connection, the container top 40 has an upper face wall part 44 as well as upper side wall parts 46 that extend away from the former, with free ends 48 (FIG. 3). The upper face wall part 44 and the upper side wall parts 46 bear a first flange 50 for attachment of the container top 40 to the lower container part 38 on their lower edge. The container top 40 is produced in one piece, from plastic, as an injection-molded part, in the exemplary embodiment shown here. Reinforcement strips 52 are molded onto it for reinforcement.

The lower container part 38 has not only a floor 54 and the rear wall 28 but also a lower face wall part 56 as well as lower side wall parts 58. The lower side wall parts 58 drop down at a slant to the lower face wall part 56, and bear a second flange 60 that is complementary to the first flange 50. The two flanges 50, 60 can be connected in simple manner, by means of screws 62. A rubber seal can be disposed between them, so that lower container part 38 and container top 40 can be joined together to form material feed container 20, in simple manner.

The material feed container 20 has a material feed opening 64 that faces upwards, which is delimited by a circumferential edge 66, 68. The circumferential edge is divided into two edge parts 66, 68. The first edge part is formed by the upper edge of the upper face wall part 44 and the upper side wall parts 46. It is followed by the second edge part 68, which is formed by the upper edge of a rubber apron 70. The latter is attached to the lower container part 38 and projects beyond the rear wall 28 and segments of the lower side wall parts 58 that extend away from the rear wall 28. The two edge parts 66, 68 align with one another.

In the lower container part 38, bearing openings 72 are disposed in the side walls 42, which serve to accommodate bearings of a stirrer mechanism. A rear wall opening 73 is disposed in the rear wall 28, by way of which the tube switch 34 can be connected with the pressure joint 30. In the lower face wall part 56, there are the feed cylinder openings 24 for connecting the feed cylinders 26. Thus, all of the components that move during pump operation are mounted in the lower container part 38, which absorbs the forces that proceed from these components. Accordingly, the lower container part 38 is produced from stable steel sheet having a thick wall. Only forces that proceed from the concrete filled into the material feed opening 64 act on the container top 40. Therefore, significantly lower requirements are set for its stability.

The lower container part 38 has pipe shaped contact elements 74 for a lattice grid that project beyond the lower face wall part 56. Alternatively, the lattice grid can also be laid onto a contact bead that faces the container interior, which is molded onto the container top 40. The material feed container 20 is attached to the chassis 10 by way of suspension devices 76.

Figure 4:
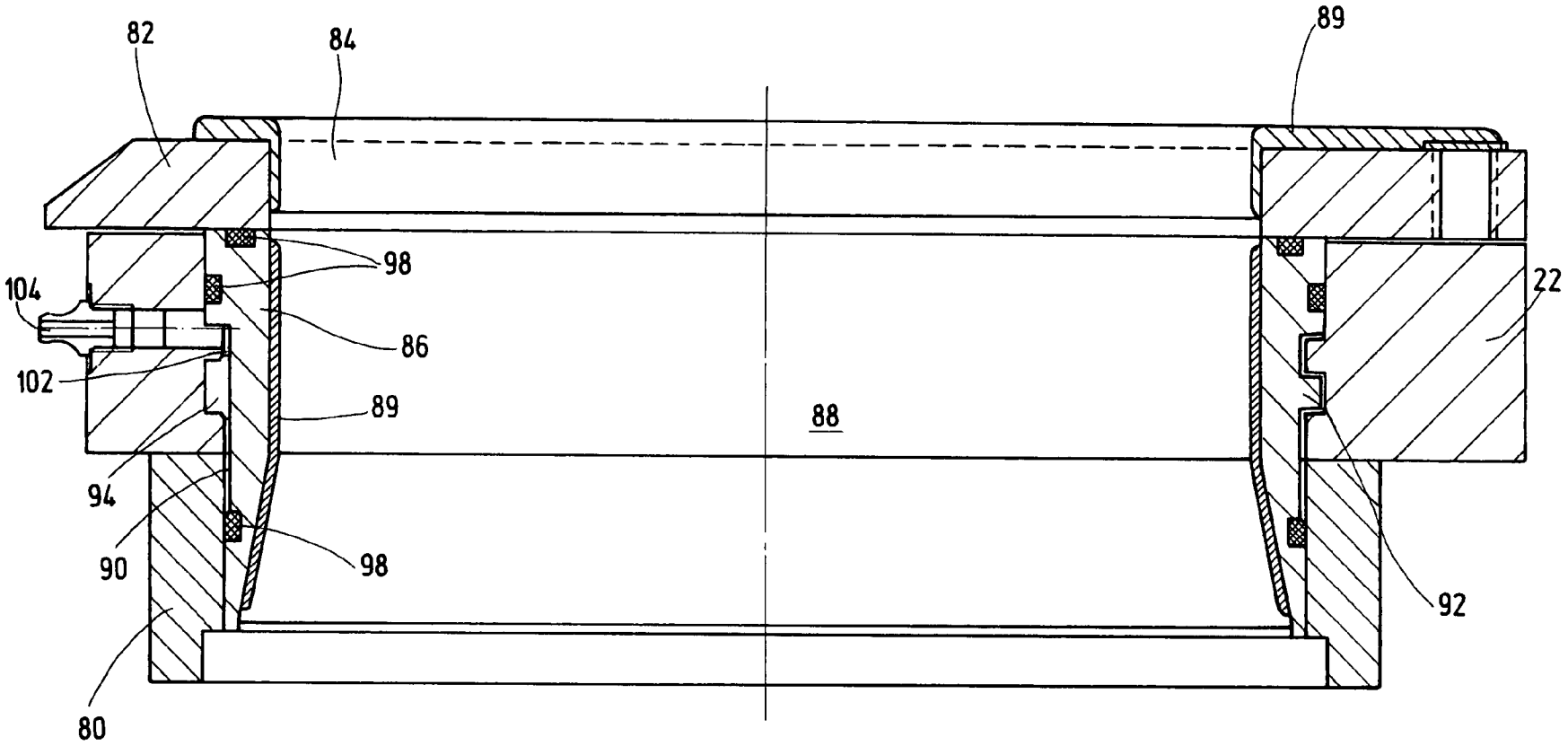
FIG. 4 a section through the container wall in the region of a feed cylinder opening.
Figure 5:
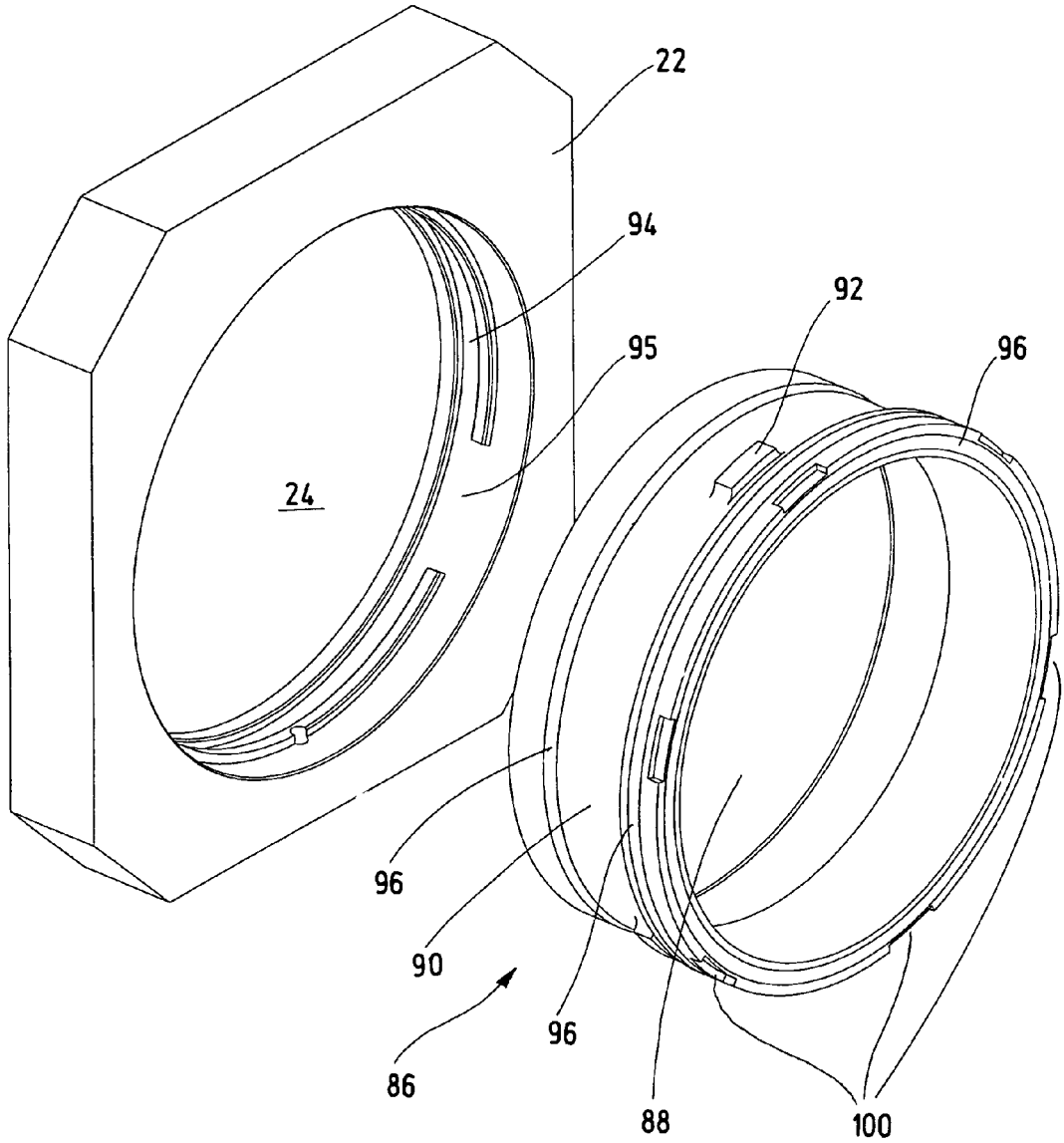
FIG. 5 a perspective view of an intermediate ring pulled out of the feed cylinder opening.

On the container outside, a connector plate 80 for connecting the feed cylinders 26 is affixed to the face wall 22. On the inside of the face wall 22, a spectacle plate 82 is releasably attached (FIG. 4), the spectacle plate openings 84 of which communicate with the feed cylinder openings 24. The spectacle plate 82 projects beyond the feed cylinder openings 24 and thus forms a stop for an intermediate ring 86 in the direction towards the container interior. The intermediate ring 86 extends, in the axial direction, beyond the feed cylinder opening 24 that extends through the face wall 22 and the connector plate 80. Its inner surface delimits a flow-through-channel 88 for the thick matter. The outer mantle surface 90 of the intermediate ring 86 bears three toes 92 disposed at an angle distance of 120°. These can be introduced into an inner groove 94 that runs circumferentially in the feed cylinder opening 24, by way of bayonet openings 95, and thus form a bayonet closure by means of which the intermediate ring 86 can be fixed in place in the feed cylinder opening 24, in the axial direction towards the feed cylinder 26. The delimitation surface of the flow-through-channel 88 aligns with the delimitation surface of the spectacle plate openings 84 as well as with the inner surfaces of the feed cylinders 26. As a result, there are no exposed edges in the feed cylinder opening 24, which would be exposed to increased friction wear due to thick matter flowing by. For a further reduction in friction wear, both the spectacle plate 82 and the delimitation surface of the flow-through-channel 88 have a friction-wear-resistant layer 89 of hard metal. To seal the feed cylinder opening 24, the intermediate ring 86 has two circumferential grooves 96 in its mantle surface 90, offset relative to the toes 92, into which sealing rings 98 are placed for contact against the face wall 22 and the connector plate 80. Another circumferential groove 96 is situated in the face surface of the intermediate ring 86 that faces the spectacle plate 82. The sealing ring 98 contained in it lies against the spectacle plate 82.

To replace the intermediate ring 86, first the spectacle plate 82 is unscrewed. Subsequently, the intermediate ring 86 is rotated about its longitudinal axis until the toes 92 can be pulled out of the bayonet openings 95. For this purpose, the intermediate ring has recesses 100 on its face surface, for inserting holder mandrels. Between the intermediate ring 86 and the face wall 22, a circumferential cavity 102 is furthermore disposed, which can be filled with grease by way of a feed opening 104. The cavity 102 increases in size as the intermediate ring 86 is pulled out of the feed cylinder opening 24 in the direction towards the container interior. Thereby, pressing in grease through the feed opening 104 facilitates removal of the intermediate ring 86. The grease furthermore acts as a lubricant, which facilitates rotation of the intermediate ring 86. As a rule, the wear parts spectacle plate 82 and intermediate ring 86 are replaced together.

Figure 2:
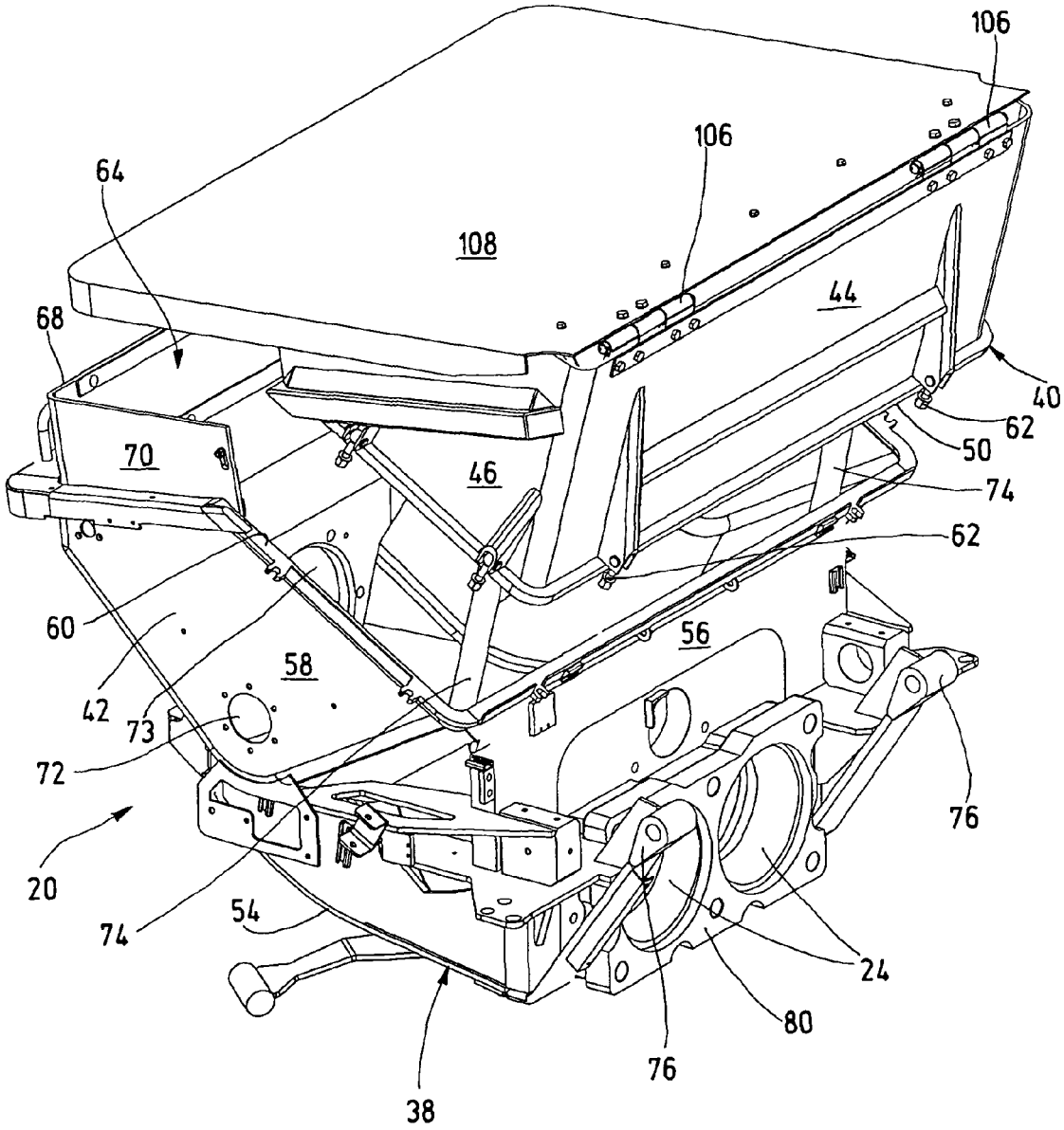
FIG. 2 a perspective view of the material feed container, with the container top lifted off.
Figure 3:
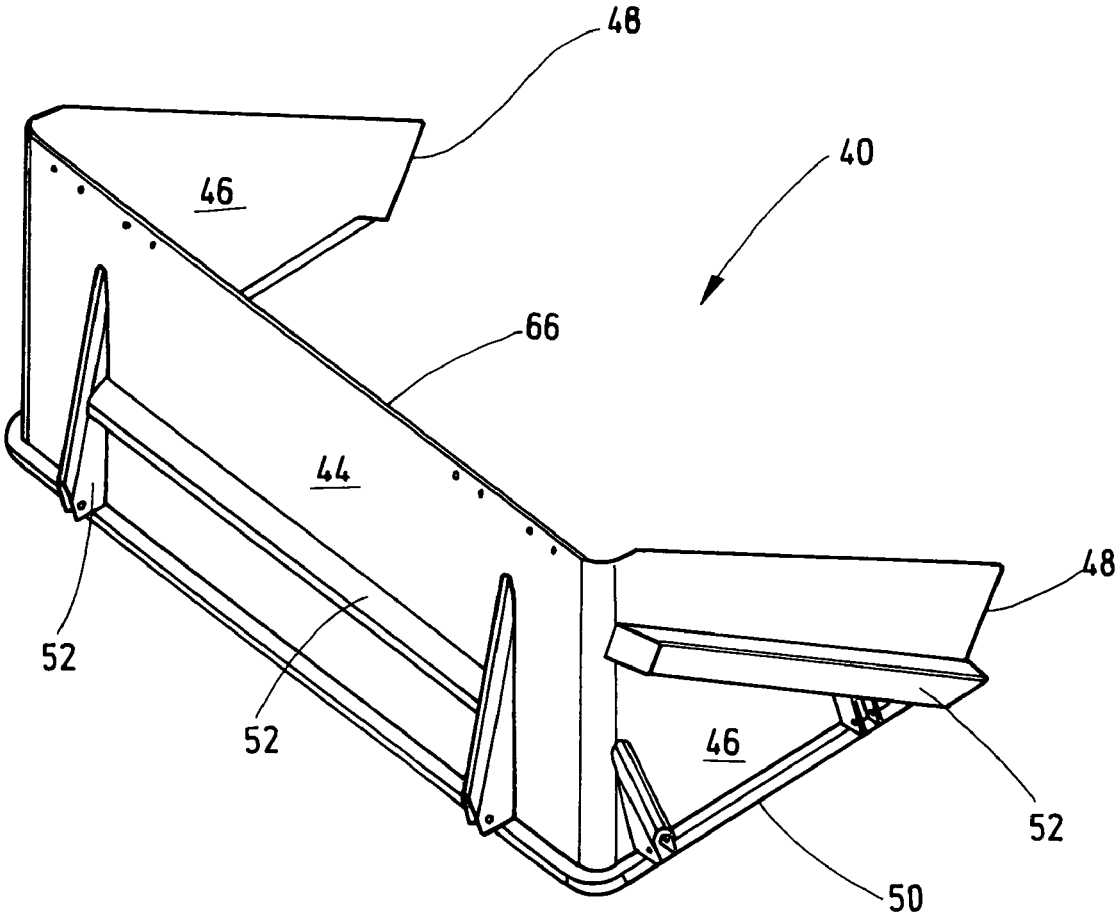
FIG. 3 a perspective view of the container top, without hinged lid.
Figure 6A:
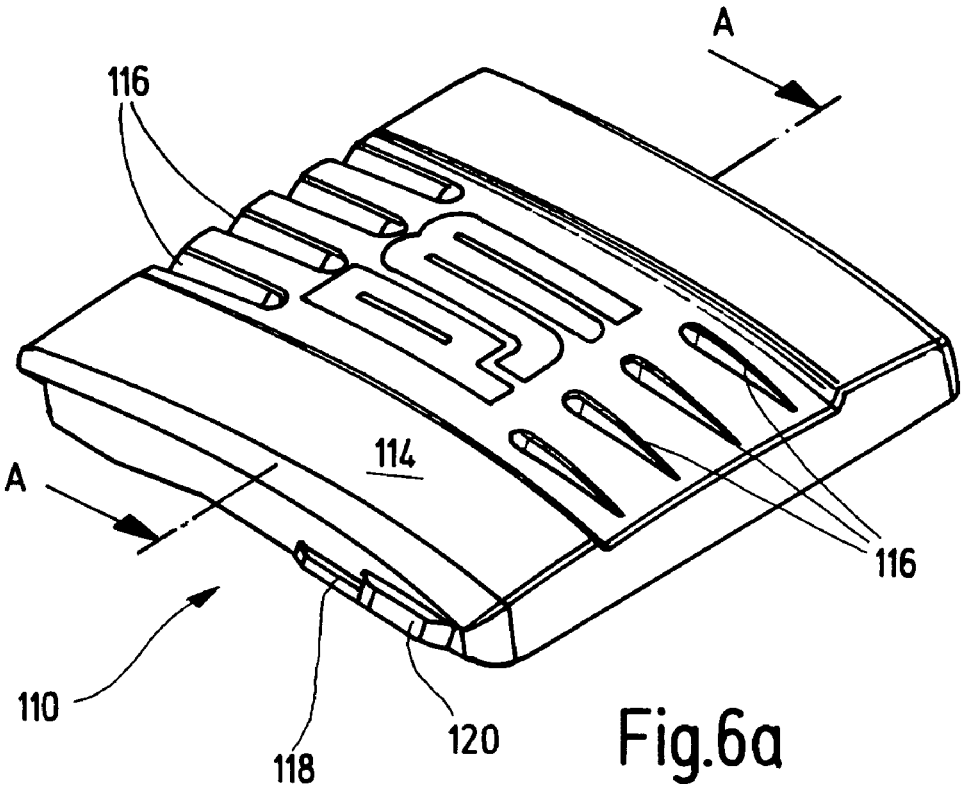
FIGS. 6*a* and 6*b* perspective views of a hinged lid according to a second exemplary embodiment, at a slant from above and a slant from below.
Figure 6B:
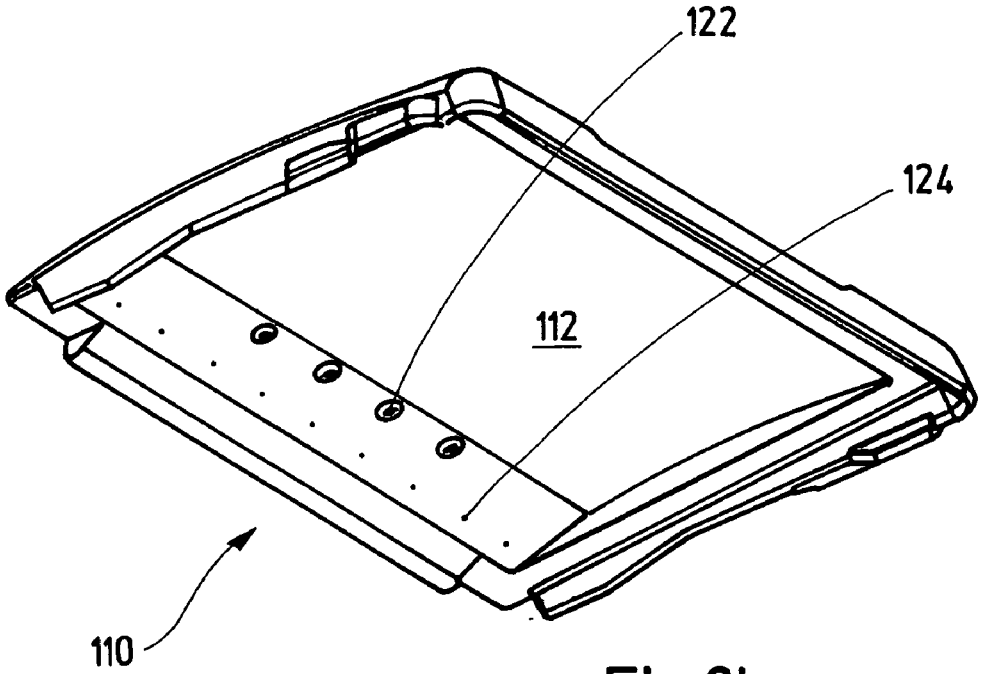
Figure 7:
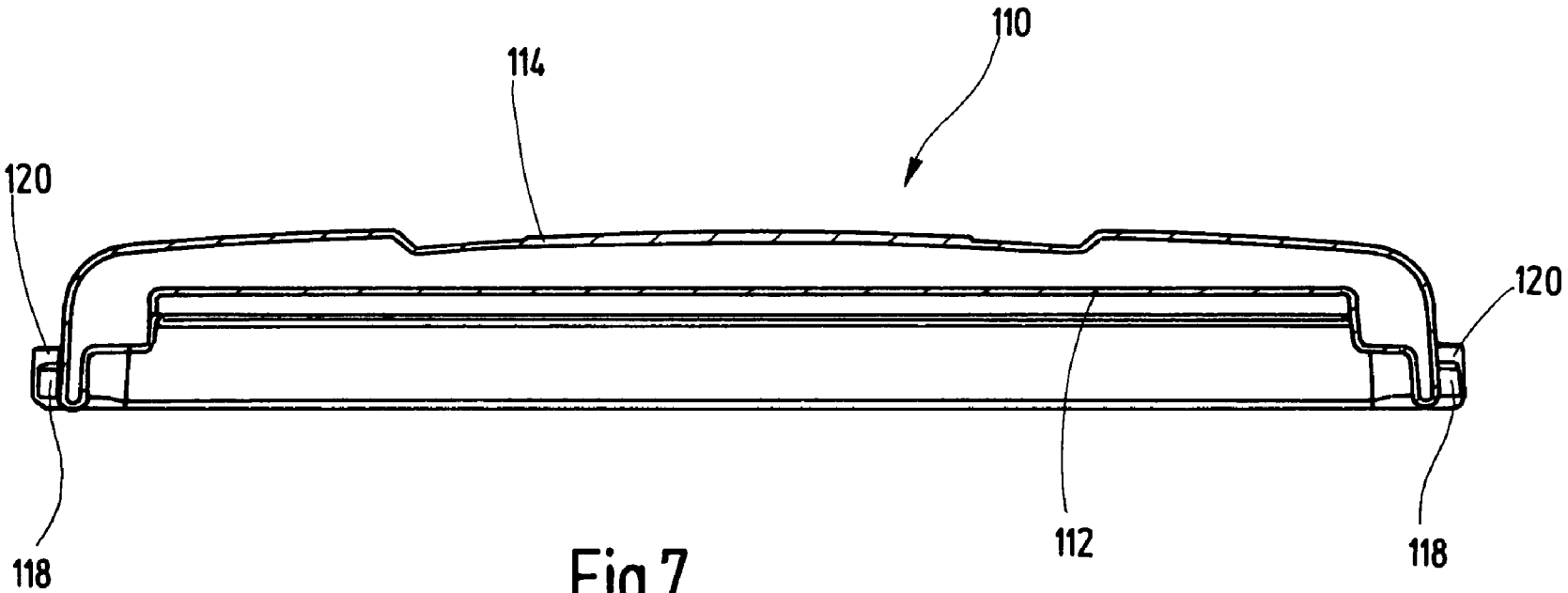
FIG. 7 a section through the hinged lid according to FIGS. 6*a* and 6*b* along the line A-A.

On the material feed container 20 according to FIG. 2, a hinged lid 108 is articulated onto the upper face wall part 44 by way of hinges 106, which lid covers the material feed opening 64. Instead of this hinged lid 108 made of metal, a hinged lid 110 made of plastic can be used, according to a second exemplary embodiment, as shown in FIGS. 6*a* and 6*b*. The hinged lid 110 is configured as a hollow plastic body, as is evident from the sectional view in FIG. 7. It has a first plastic shell 112 that faces the material feed opening 64, and a second plastic shell 114 that is connected with the former in one piece and forms a lid surface. The hinged lid 110 is produced in one piece, using a rotation casting method. The first plastic shell 112 has a smooth surface that faces the material feed opening 64, from which contamination with thick matter, particularly concrete, can be easily removed. The second plastic shell 114 has reinforcement beads 116 that increase its stability.

Figure 8A:
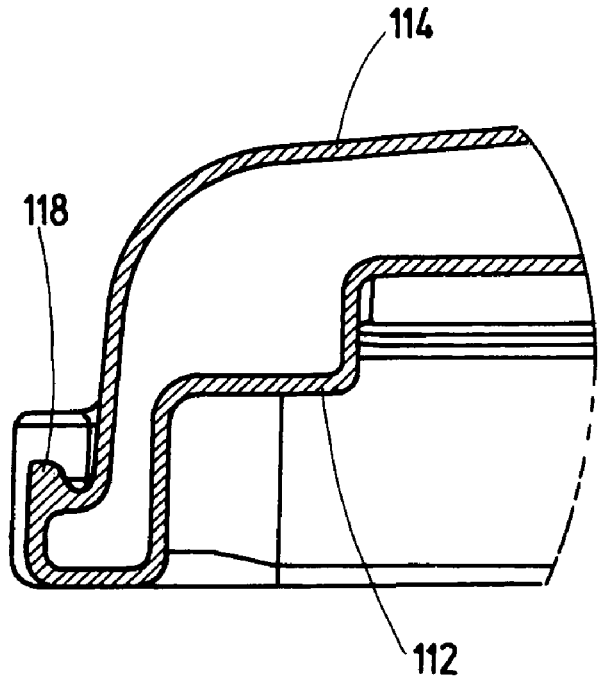
FIGS. 8*a* and 8*b* detail views of the hinged lid according to FIGS. 6*a* and 6*b* in section.
Figure 8B:
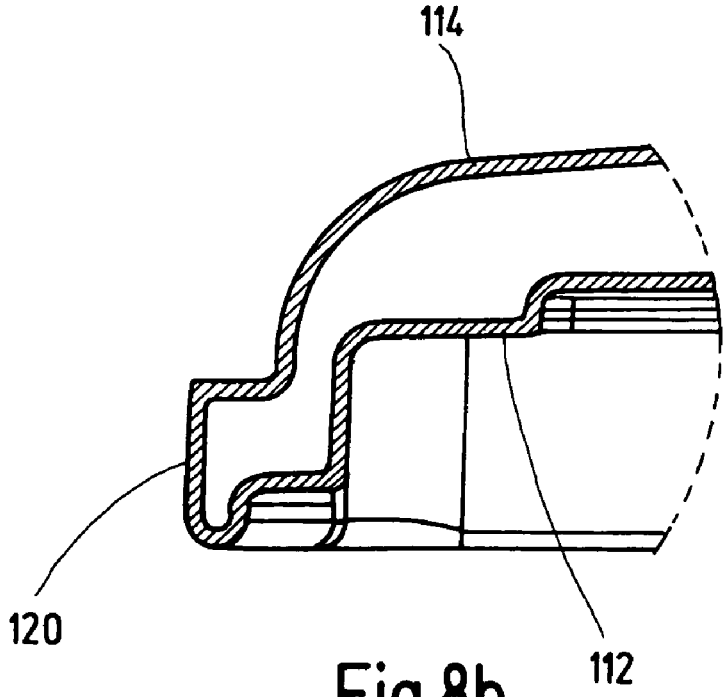

Furthermore, hooks 118 are molded onto the hinged lid 110 on the side (FIG. 8*a*), into which closure elements for forming a tension closure can be hooked to firmly close the material feed opening 64 on the material feed container 20. On the side of the hinged lid 110, handles 120 are furthermore molded on (FIG. 8*b*). Between the hinged lid 110 and the material feed container 20, gas springs can furthermore be disposed, which facilitate opening of the hinged lid 110. On the first plastic shell 112, the hinged lid 110 has bores 122, 124. A first group of bores 122 serves for affixing handles and locking elements that hold the hinged lid 110 in its open position. A second group of bores 124 serves to affix a rubber apron that covers the gap between the hinged lid 110 and the material feed container 20, and prevents thick matter from flowing through this gap.

In summary, the following should be stated:

The invention relates to a material feed container 20 for a thick-matter pump 18, having a lower container part 38 and a container top 40 releasably connected with the lower container part 38, having a two-part face wall 22, a rear wall 28, and two two-part side walls 42, in each instance, having a material feed opening 64 that points upward, delimited by a circumferential edge 66, 68, having two feed cylinder openings 24 disposed in the face wall 22, and having a tube switch 34 disposed in the container interior, which can be pivoted alternately in front of the feed cylinder openings 24 on the input side, and opens into a pressure pipe 30 on the output side. According to the invention, it is provided that the container top 40 has an upper face wall part 44 as well as upper side wall parts 46 that extend away from the former, with free ends 48, and that the circumferential edge 66, 68 has a first edge part 66 forming an upper edge of the container top 40, and a second edge part 68 following the first edge part 66, on the lower container part 38.

What is claimed is:

1. Material feed container for a thick-matter pump, comprising a material feed opening that points upward, two feed cylinder openings disposed in a container face wall, a tube switch disposed in the container interior, which can be pivoted alternately in front of the feed cylinder openings on the input side, and opens into a pressure pipe on the output side, and a hinged lid articulated onto a container wall and configured as a hollow plastic body having a first plastic shell that faces the material feed opening, and a second plastic shell forming an upper lid part.

2. Material feed container according to claim 1, wherein the first plastic shell has a smooth surface that faces the material feed opening.

3. Material feed container according to claim 1, wherein the second plastic shell has reinforcement beads.

4. Material feed container according to claim 1, wherein the hinged lid is produced in one piece, using a rotation casting method.

5. Material feed container according to claim 1, wherein the hinged lid has handles that are molded on.

6. Material feed container according to claim 1, wherein the hinged lid has hooks for hooking in closure elements attached on a container wall.

7. Material feed container according to claim 1, wherein the hinged lid is connected with the container face wall by means of at least one hinge and at least one gas spring.

8. Material feed container according to claim 7, wherein the hinged lid has an attachment device for a rubber apron close to its side connected with the container face wall.

9. Material feed container according to claim 1, wherein an intermediate ring is disposed in the feed cylinder openings, in each instance, the inner surface of which delimits a flow-through-channel for the thick matter, and the outer mantle surface of which bears at least one toe, whereby the container face wall has at least one partially circumferential inner groove in the feed cylinder opening, as well as at least one bayonet opening running from an inner surface facing the container interior to the inner groove, for accommodating the toe, forming a bayonet closure.

10. Material feed container according to claim 1, wherein the material feed opening is delimited by a circumferential edge, wherein the material feed container has a lower container part and a container top releasably connected with the lower container part, a two-part face wall, a rear wall and two two-part side walls, in each instance, wherein the feed cylinder openings are disposed in the face wall, wherein the container top has an upper face wall part as well as upper side wall parts that extend away from the upper face wall part, with free ends, and wherein the circumferential edge has a first edge part forming an upper edge of the container top, and a second edge part at the rear wall side, following the first edge part, on the lower container part.

* * * * *